US011719467B2

(12) United States Patent
Young et al.

(10) Patent No.: US 11,719,467 B2
(45) Date of Patent: Aug. 8, 2023

(54) METHOD AND SYSTEM FOR CONTROLLING AN INTERMITTENT PILOT WATER HEATER SYSTEM

(71) Applicant: Ademco Inc., Golden Valley, MN (US)

(72) Inventors: Gregory Young, Blaine, MN (US); Frederick Hazzard, Plymouth, MN (US); Adam Myre, Minnetonka, MN (US)

(73) Assignee: Ademco Inc., Golden Valley, MN (US)

( * ) Notice: Subject to any disclaimer, the term of this patent is extended or adjusted under 35 U.S.C. 154(b) by 0 days.

(21) Appl. No.: 17/649,267

(22) Filed: Jan. 28, 2022

(65) Prior Publication Data

US 2022/0146149 A1 May 12, 2022

Related U.S. Application Data

(63) Continuation of application No. 15/968,626, filed on May 1, 2018, now Pat. No. 11,236,930.

(51) Int. Cl.
*F24H 9/20* (2022.01)
*F23N 5/02* (2006.01)
(Continued)

(52) U.S. Cl.
CPC ..... *F24H 9/2035* (2013.01); *F23N 5/022* (2013.01); *F24D 18/00* (2022.01); *F24H 1/205* (2013.01);
(Continued)

(58) Field of Classification Search
CPC ..... F23M 2900/13003; F23N 5/022; F23N 2223/08; F23N 2227/02; F23N 2227/24;
(Continued)

(56) References Cited

U.S. PATENT DOCUMENTS 3,174,535 A 3/1965 Weber
3,425,780 A 2/1969 Potts
(Continued)

FOREIGN PATENT DOCUMENTS

CN 201688004 U 12/2010
EP 0967440 A2 12/1999
(Continued)

OTHER PUBLICATIONS

Response to Office Action dated Jul. 22, 202 from U.S. Appl. No. 16/993,140, filed Oct. 21, 2022, 13 pp.
(Continued)

*Primary Examiner* — Steven B McAllister
*Assistant Examiner* — Benjamin W Johnson
(74) *Attorney, Agent, or Firm* — Greenberg Traurig, LLP; Ryan D. Sharp; David J. Dykeman

(57) ABSTRACT

A water heater may include a water tank, a burner, a pilot for igniting the burner, an ignitor for igniting the pilot, a thermoelectric device in thermal communication with a flame of the pilot, a controller for controlling an ignition sequence of the pilot using the ignitor, and a rechargeable power storage device for supplying power to the ignitor and the controller. The rechargeable power storage device may be rechargeable using the energy produced by the thermoelectric device. The controller is configured to selectively ran only the pilot for at least pan of a heating cycle to increase the recharge lime of the rechargeable power storage device while still healing the water in the water heater.

10 Claims, 13 Drawing Sheets

(51) Int. Cl.
*F24H 1/20* (2022.01)
*F24H 9/1836* (2022.01)
*F24D 18/00* (2022.01)
*F24D 101/60* (2022.01)

(52) U.S. Cl.
CPC . *F24H 9/1836* (2013.01); *F23M 2900/13003* (2013.01); *F23N 2223/08* (2020.01); *F23N 2227/02* (2020.01); *F23N 2227/24* (2020.01); *F23N 2227/30* (2020.01); *F23N 2231/02* (2020.01); *F23N 2237/10* (2020.01); *F23N 2241/04* (2020.01); *F24D 2101/60* (2022.01); *F24H 2240/01* (2013.01)

(58) Field of Classification Search
CPC ..... F23N 2227/30; F23N 2231/02; F23N 2237/10; F23N 2241/04; F24D 18/00; F24D 2101/60; F24H 1/205; F24H 9/1836; F24H 9/2035; F24H 2240/01
USPC ..... 122/14.21
See application file for complete search history.

(56) References Cited

U.S. PATENT DOCUMENTS 3,520,645 A 7/1970 Cotton et al.
3,574,496 A 4/1971 Hewitt
3,649,156 A 3/1972 Conner
3,681,001 A 8/1972 Potts
3,734,676 A 5/1973 Wyland
3,836,857 A 9/1974 Ikemgami et al.
3,877,864 A 4/1975 Carlson
3,887,325 A 6/1975 Finger et al.
3,909,816 A 9/1975 Teeters
4,033,711 A 7/1977 Christian et al.
4,131,413 A 12/1978 Ryno
4,157,506 A 6/1979 Spencer
4,221,557 A 9/1980 Jalics
4,242,079 A 12/1980 Matthews
4,280,184 A 7/1981 Weiner et al.
4,303,385 A 12/1981 Rudich, Jr. et al.
4,370,557 A 1/1983 Axmark et al.
4,450,499 A 5/1984 Sorelle
4,457,692 A 7/1984 Erdman
4,483,672 A 11/1984 Wallace et al.
4,518,345 A 5/1985 Mueller et al.
4,521,825 A 6/1985 Crawford
4,527,247 A 7/1985 Kaiser et al.
4,555,800 A 11/1985 Nishikawa et al.
4,622,005 A 11/1986 Kuroda
4,655,705 A 4/1987 Shute et al.
4,672,324 A 6/1987 Van Kampen
4,695,246 A 9/1987 Beilfuss et al.
4,709,155 A 11/1987 Yamaguchi et al.
4,770,629 A 9/1988 Bohan, Jr.
4,777,607 A 10/1988 Maury et al.
4,778,378 A 10/1988 Dolnick et al.
4,830,601 A 5/1989 Dahlander et al.
4,842,510 A 6/1989 Grunden et al.
4,843,084 A 6/1989 Parker et al.
4,904,986 A 2/1990 Pinckaers
4,906,177 A 3/1990 Newberry et al.
4,906,178 A 3/1990 Goldstein et al.
4,949,355 A 8/1990 Dyke et al.
4,984,981 A 1/1991 Pottebaum
5,026,270 A 6/1991 Adams et al.
5,026,272 A 6/1991 Takahashi et al.
5,035,607 A 7/1991 Peterson
5,037,291 A 8/1991 Clark
5,073,769 A 12/1991 Kompelien
5,077,550 A 12/1991 Cormier
5,090,895 A 2/1992 Jensen et al.
5,112,217 A 5/1992 Ripka et al.
5,126,721 A 6/1992 Butcher et al.
5,157,447 A 10/1992 Farnand et al.
5,174,743 A 12/1992 Wellman et al.
5,175,439 A 12/1992 Harer et al.
5,180,301 A 1/1993 Gross
5,222,888 A 6/1993 Jones et al.
5,236,328 A 8/1993 Tate et al.
5,251,815 A 10/1993 Foye
5,255,179 A 10/1993 Zekan et al.
5,261,609 A 11/1993 Roth
5,276,630 A 1/1994 Baldwin et al.
5,280,802 A 1/1994 Comuzie, Jr.
5,300,836 A 4/1994 Cha
5,346,391 A 9/1994 Fulleman et al.
5,365,223 A 11/1994 Sigafus
5,368,230 A 11/1994 Oppenberg
5,391,074 A 2/1995 Meeker
5,423,479 A 6/1995 Nichols
5,424,554 A 6/1995 Marran et al.
5,446,677 A 8/1995 Jensen
5,472,336 A 12/1995 Adams et al.
5,506,569 A 4/1996 Rowlette
5,515,297 A 5/1996 Bunting
5,544,645 A 8/1996 Armijo et al.
5,567,143 A 10/1996 Servidio
5,599,180 A 2/1997 Peters et al.
5,636,981 A 6/1997 Lilly
5,682,329 A 10/1997 Seem et al.
5,722,823 A 3/1998 Hodgkiss
5,795,462 A 8/1998 Shurtleff
5,797,358 A 8/1998 Brandt et al.
5,899,684 A 5/1999 McCoy et al.
5,921,470 A 7/1999 Kamath
5,931,655 A * 8/1999 Maher, Jr. ..... F23N 5/102 431/46
5,971,745 A 10/1999 Bassett et al.
6,004,127 A 12/1999 Heimberg et al.
6,059,195 A 5/2000 Adams et al.
6,060,719 A 5/2000 DiTucci et al.
6,071,114 A 6/2000 Cusack et al.
6,084,518 A 7/2000 Jamieson
6,092,738 A 7/2000 Becker
6,099,295 A 8/2000 McCoy et al.
6,129,284 A 10/2000 Adams et al.
6,135,366 A 10/2000 Bodelin et al.
6,222,719 B1 4/2001 Kadah
6,236,321 B1 5/2001 Trrost, IV
6,257,871 B1 7/2001 Weiss et al.
6,260,773 B1 7/2001 Kamath
6,261,086 B1 7/2001 Fu
6,261,087 B1 7/2001 Bird et al.
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl, Jr.
6,474,979 B1 11/2002 Rippelmeyer
6,478,573 B1 11/2002 Chian
6,486,486 B1 11/2002 Haupenthal
6,509,838 B1 1/2003 Payne et al.
6,552,865 B2 4/2003 Cyrusian
6,560,409 B2 5/2003 Troost, IV
6,561,792 B1 5/2003 Pfund
6,676,404 B2 1/2004 Lochschmied
6,684,821 B2 2/2004 Lannes et al.
6,700,495 B2 3/2004 Mindermann et al.
6,701,874 B1 3/2004 Schultz et al.
6,743,010 B2 6/2004 Bridgeman et al.
6,782,345 B1 8/2004 Siegel et al.
6,794,771 B2 9/2004 Orloff
6,829,123 B2 12/2004 Legatti et al.
6,862,165 B2 3/2005 Chian et al.
6,881,055 B2 4/2005 Bird
6,912,671 B2 6/2005 Christensen et al.
6,917,888 B2 7/2005 Loginov et al.
6,920,377 B2 7/2005 Chian
6,923,640 B2 8/2005 Canon
6,953,161 B2 10/2005 Laursen et al.
6,955,301 B2 10/2005 Munsterhuis et al.

(56) References Cited

U.S. PATENT DOCUMENTS

| | | | |
|---|---|---|---|
| 6,959,876 | B2 | 11/2005 | Chian et al. |
| 7,073,524 | B2 | 7/2006 | Chian |
| 7,076,373 | B1 | 7/2006 | Munsterhuis et al. |
| 7,088,137 | B2 | 8/2006 | Behrendt et al. |
| 7,088,253 | B2 | 8/2006 | Grow |
| 7,167,813 | B2 | 1/2007 | Chian et al. |
| 7,170,762 | B2 | 1/2007 | Chian et al. |
| 7,202,794 | B2 | 4/2007 | Huseynov et al. |
| 7,241,135 | B2 | 7/2007 | Munsterhuis et al. |
| 7,252,502 | B2 | 8/2007 | Munsterhuis |
| 7,255,285 | B2 | 8/2007 | Froost et al. |
| 7,274,973 | B2 | 9/2007 | Nichols et al. |
| 7,289,032 | B2 | 10/2007 | Seguin et al. |
| 7,314,370 | B2 | 1/2008 | Chian et al. |
| 7,317,265 | B2 | 1/2008 | Chian et al. |
| 7,327,269 | B2 | 2/2008 | Kiarostami |
| 7,435,081 | B2 | 10/2008 | Munsterhuis |
| 7,604,478 | B2 | 10/2009 | Anderson et al. |
| 7,617,691 | B2 | 11/2009 | Street et al. |
| 7,712,677 | B1 | 5/2010 | Munsterhuis et al. |
| 7,721,972 | B2 | 5/2010 | Bracken et al. |
| 7,728,736 | B2 | 6/2010 | Leeland et al. |
| 7,764,182 | B2 | 7/2010 | Chian et al. |
| 7,768,410 | B2 | 8/2010 | Chian |
| 7,798,107 | B2 | 9/2010 | Chian et al. |
| 7,800,508 | B2 | 9/2010 | Chian et al. |
| 7,804,047 | B2 | 9/2010 | Zak et al. |
| 7,944,678 | B2 | 5/2011 | Kaplan et al. |
| 8,066,508 | B2 | 11/2011 | Nordberg et al. |
| 8,070,482 | B2 | 12/2011 | Fuentes et al. |
| 8,074,892 | B2 | 12/2011 | Bracken et al. |
| 8,085,521 | B2 | 12/2011 | Chian |
| 8,123,517 | B2 | 2/2012 | Peruch |
| 8,165,726 | B2 | 4/2012 | Nordberg et al. |
| 8,177,544 | B2 | 5/2012 | Anderson |
| 8,245,987 | B2 | 8/2012 | Hazzard et al. |
| 8,297,524 | B2 | 10/2012 | Kucera et al. |
| 8,300,381 | B2 | 10/2012 | Chian et al. |
| 8,310,801 | B2 | 11/2012 | McDonald et al. |
| 8,322,312 | B2 | 12/2012 | Strand |
| 8,337,081 | B1 | 12/2012 | Holmberg et al. |
| 8,473,229 | B2 | 6/2013 | Kucera et al. |
| 8,485,138 | B2 | 7/2013 | Leeland |
| 8,512,034 | B2 | 8/2013 | Young et al. |
| 8,523,560 | B2 | 9/2013 | Anderson et al. |
| 8,632,017 | B2 | 1/2014 | Kucera et al. |
| 8,636,502 | B2 | 1/2014 | Anderson |
| 8,636,503 | B2 | 1/2014 | Kasprzyk et al. |
| 8,659,437 | B2 | 2/2014 | Chian |
| 8,770,152 | B2 | 7/2014 | Leeland et al. |
| 8,780,726 | B2 | 7/2014 | Anglin et al. |
| 8,875,557 | B2 | 11/2014 | Chian et al. |
| 8,875,664 | B2 | 11/2014 | Strand |
| 9,249,987 | B2 | 2/2016 | Foster et al. |
| 9,303,869 | B2 | 4/2016 | Kasprzyk et al. |
| 9,388,984 | B2 | 7/2016 | Anderson |
| 9,435,566 | B2 | 9/2016 | Hill et al. |
| 9,494,320 | B2 | 11/2016 | Chian et al. |
| 9,752,990 | B2 | 9/2017 | Chian et al. |
| 10,151,482 | B2 | 12/2018 | Teng et al. |
| 11,236,930 | B2 | 2/2022 | Young et al. |
| 2002/0099474 | A1 | 7/2002 | Khesin |
| 2003/0222982 | A1 | 12/2003 | Hamdan et al. |
| 2004/0209209 | A1 | 10/2004 | Chodacki et al. |
| 2005/0086341 | A1 | 4/2005 | Enga et al. |
| 2005/0161518 | A1 | 7/2005 | Munsterhuis |
| 2006/0084019 | A1 | 4/2006 | Berg et al. |
| 2007/0143000 | A1 | 6/2007 | Bryant et al. |
| 2010/0075264 | A1 | 3/2010 | Kaplan et al. |
| 2010/0199640 | A1 | 8/2010 | Kodo |
| 2011/0277706 | A1* | 11/2011 | Arnold ..... F24H 1/205 122/14.1 |
| 2014/0165927 | A1 | 6/2014 | Zelepouga et al. |
| 2014/0199640 | A1* | 7/2014 | Chian ..... F23C 9/00 431/71 |
| 2014/0199641 | A1* | 7/2014 | Chian ..... F24H 1/186 431/28 |
| 2015/0276268 | A1* | 10/2015 | Hazzard ..... F23N 5/242 431/15 |
| 2015/0277463 | A1 | 10/2015 | Hazzard et al. |
| 2016/0265811 | A1* | 9/2016 | Furmanek ..... F24H 9/2035 |
| 2016/0305827 | A1 | 10/2016 | Heil et al. |
| 2016/0353929 | A1 | 12/2016 | McLemore et al. |
| 2017/0115005 | A1 | 4/2017 | Chian et al. |
| 2019/0338987 | A1 | 11/2019 | Young et al. |
| 2021/0274963 | A1 | 9/2021 | Ravazzani |

FOREIGN PATENT DOCUMENTS

| | | | |
|---|---|---|---|
| EP | 1039226 | A2 | 9/2000 |
| EP | 1148298 | A1 | 10/2001 |
| GB | 1509704 | A | 5/1978 |
| GB | 2193758 | A | 2/1988 |
| KR | 101852868 | A | 4/2018 |
| WO | 9718417 | A1 | 5/1997 |
| WO | 0171255 | A1 | 9/2001 |
| WO | 2011031263 | A1 | 3/2011 |

OTHER PUBLICATIONS

"A First Proposal to a Protocol of Determination of Boiler Parameters for the Annual Efficiency Method for Donestic Boilers," 2nd edition, 18 pages, Jul. 1998.

"Results and Methodology of the Engineering Analysis for Residential Water Heater Efficiency Standards," 101 pages, Oct. 1998.

Aaron and Company, "Aaronews," vol. 27 No. 6, 4 pages, Dec. 2001.

Beckett Residential Burners, "AF/AFG Oil Burner Manual," 24 pages, Aug. 2009.

Dungs, "Automatic Gas Burner Controller for Gas Burners with or without fan," Edition 10.08, 6 pages, downloaded Mar. 25, 2013.

Honeywell, "S4965 Series Combined Valve and Boiler Control Systems," 16 pages, prior to 2009.

Honeywell, "S923F1006 2-Stage Hot Surface Ignition Integrated Furnace Controls, Installation Instructions," 20 pages, 2006.

Honeywell, "SV9410/SV9420; SV9510/SV9520; SV9610/SV9620 Smart Valve System Controls," Installation Instructions, 16 pages, 2003.

Prosecution History from U.S. Appl. No. 15/968,626, dated Jun. 12, 2020 through Sep. 27, 2021, 74 pp.

Robertshaw, "Control Tips," 3 pages, 2010.

Tradeline, "Oil Controls, Service Handbook," 84 pages, prior to Apr. 9, 2010.

Underwriters Laboratories Inc. (UL), "UL 296, Oil Burners," ISBN 1-55989-627-2, 107 pages, Jun. 30, 1994.

Vaswani et al., "Advantages of Pulse Firing in Fuel-Fired Furnaces for Precise Low-Temperature Control," downloaded from: www.steelworld.com/tecmay02.htm, 6 pages, Mar. 25, 2013.

Wu et al., "A Web 2.0-Based Scientific Application Framework," 7 pages, Jan. 22, 2013.

www.playhookey.com, "Series LC Circuits," 5 pages, printed Jun. 15, 2007.

Office Action from U.S. Appl. No. 16/993,140 dated Jul. 22, 2022, 14 pp.

* cited by examiner

METHOD AND SYSTEM FOR CONTROLLING AN INTERMITTENT PILOT WATER HEATER SYSTEM

This application is a continuation of U.S. patent application Ser. No. 15/968,626, filed 01 May 2018, the entire contents of which is incorporated herein by reference.

TECHNICAL FIELD

The present disclosure relates generally to intermittent flame-powered pilot combustion systems, and more particularly to systems and methods for controlling a water heater having an intermittent flame-powered pilot combustion system.

Energy efficiency is increasingly important for gas-powered appliances, such as hot water heaters, space heaters, and furnaces. In many gas-powered appliances, a flame powered combustion controller is used, where energy from a standing pilot flame is used to power the combustion controller. Standing pilot systems often obtain electrical power after a successful ignition sequence from a thermoelectric device (e.g., a thermopile) capable of generating electricity using the flame from the pilot burner, the main burner, or both. Thus, no external power source may be required. Line voltage power is typically not conveniently available where standing pilot systems are installed. As such, in many such systems, if the pilot flame is extinguished, power is lost to the combustion controller.

To improve energy efficiency, intermittent pilot systems have been developed. Intermittent pilot systems typically have a spark ignition system that ignites a pilot flame during each call for heat to the gas-powered appliance. Once the pilot flame is ignited, a main valve of the gas-powered appliance may be activated, allowing the pilot flame to ignite a main burner. Once the call for heal is satisfied, the main burner and pilot flame may be extinguished, thereby saving energy and cost. A drawback of many intermittent pilot systems is they require line voltage to operate.

What would be desirable is a way to operate a flame powered system in a manner similar to an intermittent pilot system. This requires storing electrical energy that the system generates for later use to reignite the pilot and/or main burner and to operate the control for a period of time.

SUMMARY

The present disclosure relates generally to intermittent flame-powered pilot combustion systems and more specifically to systems and methods for controlling a water heater having an intermittent flame-powered pilot combustion system.

An example water heater may include a water tank, a main burner, a pilot for igniting the main burner, an ignitor for igniting the pilot, a thermoelectric device in thermal communication with a flame of the pilot, a controller for controlling an ignition sequence of the pilot using the ignitor, and a rechargeable power storage device for supplying power to the ignitor and the controller. The rechargeable power storage device may be rechargeable using the energy produced by the thermoelectric device. During operation, when the rechargeable power storage device is detected to have a charge that has not fallen below a charge threshold, the pilot and the main burner may be run to heat the water in the wafer lank when the temperature of the water in the water tank falls to a lower temperature setpoint threshold, and both the pilot and the main burner are terminated when the temperature of die water in the water tank reaches an upper temperature setpoint threshold. However, when the rechargeable power storage device is detected to have a charge that has fallen below the charge threshold, an illustrative method may include: when the temperature of the water in the water tank is at or above the lower temperature setpoint threshold and below the upper temperature setpoint threshold, run the pilot but not the main burner to heat die water in the water tank for a first heating segment toward the upper temperature setpoint threshold, and run the pilot and the main burner to heat the water in the water tank for a second heating segment toward the upper temperature setpoint threshold. It is contemplated that the charge threshold may he at or near a full charge, 10 percent below a full charge, 20 percent below a full charge, or any other suitable charge threshold.

It is contemplated that the first heating segment may occur before or after the second heating segment. In some eases, the first heating segment and the second healing segment may be configured such that there is sufficient time to fully recharge the rechargeable power storage device using energy produced by the thermoelectric device at or before the water in the water tank is heated to the upper temperature setpoint threshold.

In another example, it is contemplated that the controller of the water heater may be configured to control the pilot and the main burner to maintain the temperature of water in the water tank between a lower temperature setpoint threshold and an upper temperature setpoint threshold. The controller may detect when the rechargeable power storage device has a charge that has fallen below a charge threshold, and in response, the controller may control the pilot and the main burner to fully recharge the rechargeable power storage device while maintaining the temperature of water in the water tank between the lower temperature setpoint threshold and the upper temperature setpoint threshold.

In some cases, the controller is configured to determine when the temperature of the water in the water tank is at or above the lower temperature setpoint threshold and below the upper temperature setpoint threshold, and when the rechargeable power storage device has a charge that has fallen below the charge threshold, and in response, the controller may am the pilot but not the main burner to heat the water in the water tank for a first heating segment toward the upper temperature setpoint, threshold, and run the pilot and the main burner to heat the wafer in the water tank for a second heating segment toward the upper temperature setpoint threshold. The first healing segment and the second heating segment may be configured such that there is sufficient time to fully recharge the rechargeable power storage device using energy produced by the thermoelectric device at or before the time that the water in the water tank is heated to the upper temperature setpoint threshold.

The controller may be configured to detect when the rechargeable power storage device has a charge that has not fallen below a charge threshold, and in response, run the pilot and the main burner to heat the water in the water tank when the temperature of the water in the water tank falls to the lower temperature setpoint threshold, and not run the pilot or the main burner when the temperature of the water in the water tank rises to the upper temperature setpoint threshold.

In some instances, a water usage profile may be used to determine a higher water usage period and a lower water usage period. The usage profile may include of multiple higher water usage periods and multiple lower water usage periods which may have various temperature setpoints, upper temperature setpoint thresholds, and lower temperature setpoint thresholds. When the rechargeable power storage device has a charge that has fallen below a charge threshold, and during the high water usage periods, the controller may run the pilot and the main burner to heat the water in the water tank when the temperature of the water in the water tank falls to a lower temperature setpoint threshold, and the controller may not run either the pilot or the main burner when the temperature of the water in the wafer tank reaches an upper temperature setpoint threshold. When the rechargeable power storage device has a charge that has fallen below a charge threshold, and during the low water usage periods, the controller may run the pilot but not the main burner to heat the water in the water tank for a first heating segment toward the upper temperature setpoint threshold when the temperature of the water in the water tank is at or above the lower temperature setpoint threshold and below the upper temperature setpoint threshold. In some cases, when the rechargeable power storage device has a charge that has fallen below a charge threshold, and during the higher water usage period, the controller may run the pilot and the main burner to heat the water in the water tank fora second heating segment toward the upper temperature setpoint threshold. It is contemplated that the first heating segment may occur before or after the second healing segment, in some cases, the first heating segment and the second healing segment may be configured such that there is sufficient time to folly recharge the rechargeable power storage device using energy produced by the thermoelectric device at or before the time that the water in the water tank is heated to the upper temperature setpoint threshold.

In some cases, a water draw may cause the water temperature to fall below the lower temperature setpoint threshold (i.e., the water temperature is not at a temperature that is at or above the lower temperature setpoint threshold). In these cases, the controller may run the main burner to recover the water temperature to a temperature that is at or above the lower temperature setpoint threshold but still below the upper temperature setpoint threshold. If the charge level is below the upper charge limit, running the main burner may charge the rechargeable power storage device. In some eases, when the water temperature reaches the lower temperature setpoint threshold, the controller may run the pilot to complete the charging of the rechargeable power storage device or run the pilot for a first heating segment followed by the pilot and main burner for a second heating segment to complete the charging of the rechargeable power storage device.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may he more completely understood in consideration of the following description of various embodiments in connection with the accompanying drawings, in which.

DESCRIPTION

Figure 1:
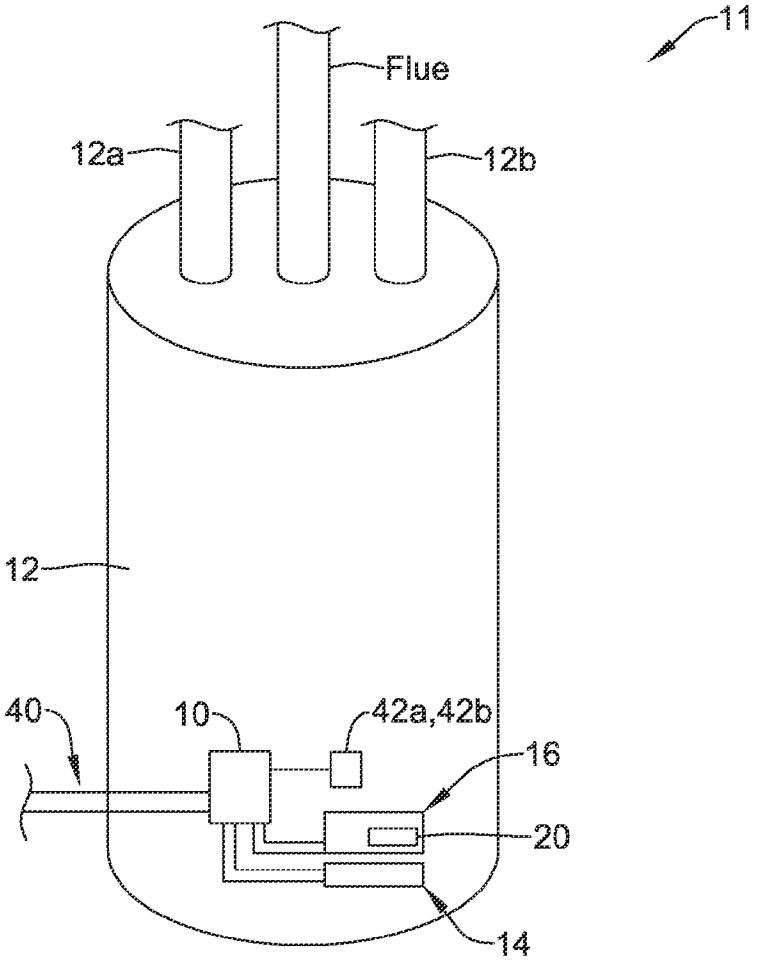
FIG. 1 is a schematic view of an example water heater having an intermittent flame-powered pilot combustion system.

The following description should he read with reference to the drawings wherein like reference numerals indicate like elements throughout the several views. The description and drawings show several embodiments which are meant to be illustrative in nature.

Figure 2:
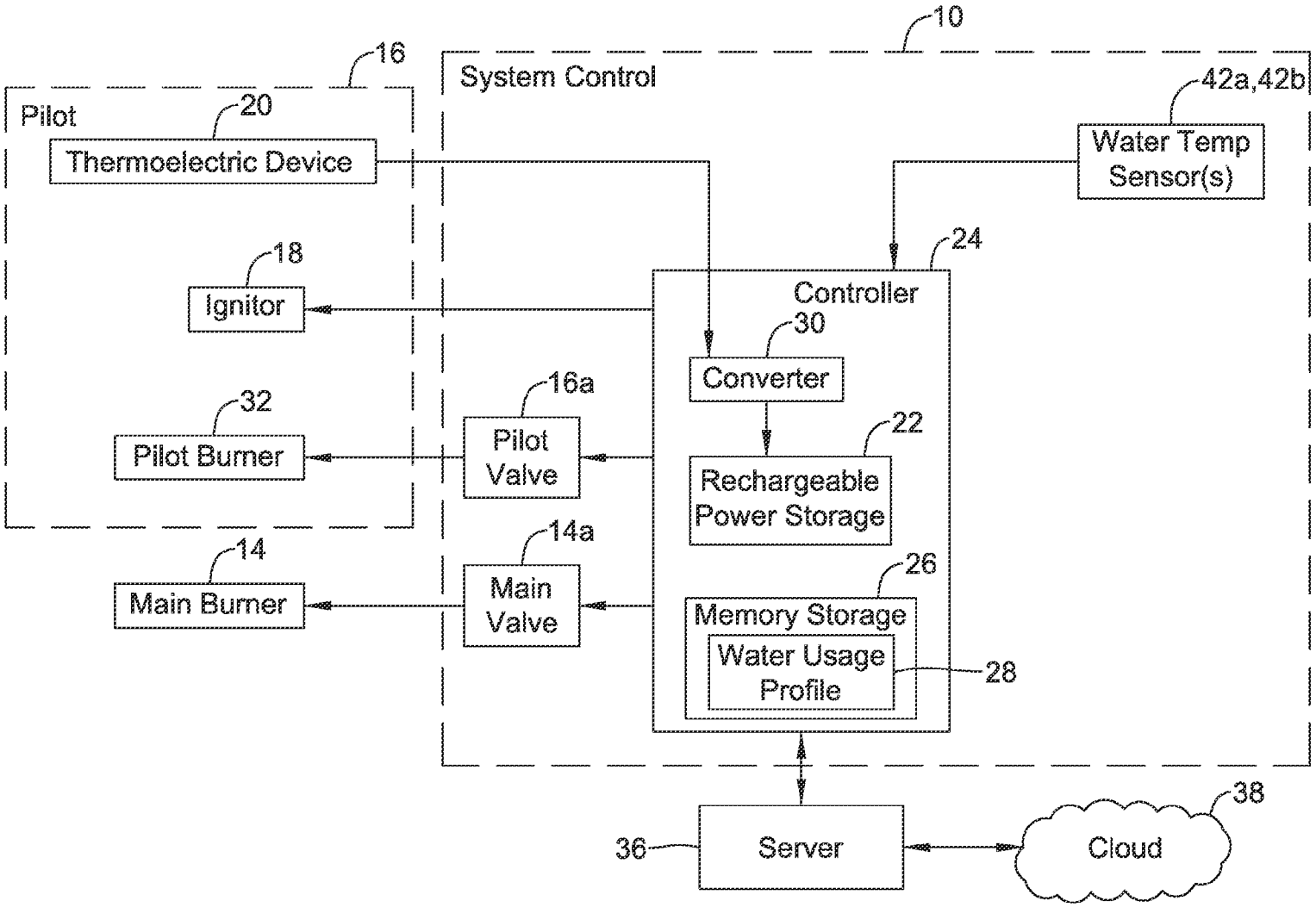
FIG. 2 is a schematic block diagram of the example water heater shown in FIG. 1.

FIGS. 1 and 2 depict an exemplary water heater 11 having an intermittent flame-powered pilot combustion system. As shown in FIG. 1, the water heater 11 may include a water tank 12, having a water inlet 12A and a water outlet 12B. The combustion exhaust of the water heater 11 may exit the water heater 11 through a flue. The water heater 11 may further include a main burner 14, a pilot 16 which is configured to ignite the main burner 14, an ignitor 18 for igniting the pilot 16, and a system control 10 having a main valve 14A and a pilot valve 16A. The main valve 14A and the pilot valve 16A may provide communication with a gas supply 40. A thermoelectric device 20 (e.g., a thermopile) may be in thermal communication with a flame of the pilot burner 32. The thermoelectric device 20 converts heat, generated by the pilot burner 32 and/or the main burner 14 to an electrical potential or voltage. The water heater 11 may further include a system control 10 containing a rechargeable power storage device 22 (e.g., a battery and/or a capacitor). The rechargeable power storage device 22 may be configured to provide power to the controller 24. The controller 24 is responsible for the overall control of the system, and directs the power from the rechargeable power storage device 22 to other system control 10 elements (e.g., ignitor 18, pilot value 16A, main valve 14A) when they are required to be powered for system operation.

As shown in FIG. 2, the system control 10 may include a controller 24 operatively coupled to a memory storage 26, the main valve 14A, the pilot valve 16A, the thermoelectric device 20 and water temperature sensors 42A and or 42B.

The system control 10 may monitor the water temperature in the water heater 11 via the water temperature sensor(s) 42A and/or 42B. and control the pilot valve 16A and the main valve 14A in accordance with a desired water temperature set point To help prevent excessive on and off cycling of the main burner 14, the desired water temperature set point (e.g. 140 degrees F) may include an upper temperature setpoint threshold (e.g. 140 degrees F) and a lower temperature setpoint threshold (e.g. 125 degrees F). In conventional water heater designs, the main burner 14 is activated after the water temperature drifts down from the upper temperature setpoint threshold to the lower temperature setpoint threshold through heat loss from the water heater tank and/or water draw(s) to heat the water in the water tank 12, and turns the main burner 14 off when the water temperature reaches the upper temperature setpoint threshold. The temperature differential between the upper temperature setpoint threshold and the lower temperature setpoint threshold is often referred to as a temperature dead hand, and the size of the dead hand may be set to achieve a desired cycle rate under steady state conditions.

During operation, the controller 24 may initiate an ignition sequence. During the ignition sequence, the controller 24 may command a pilot valve 16A to open to supply gas to the pilot 16. Once gas is present at the pilot 16, the controller 24 may command the ignitor 18 to ignite a flame at the pilot burner 32. The controller 24 may then command the main valve 14A to open to allow ignition of a main flame of the main humor 14 using the pilot flame.

The thermoelectric device 20 may be exposed to the pilot flame, and thus may generate power whenever the pilot flame is present. The rechargeable power storage device 22 (e.g., a battery and/or a capacitor) may be configured to be rechargeable using energy produced by the thermoelectric device 20. The controller 24 may be in communication with the thermoelectric device 20 and the rechargeable power storage device 22, and may be configured to monitor and maintain a charge level of the rechargeable power storage device 22 at or above a charge threshold. When the controller 24 detects that the rechargeable power storage device 22 has a charge level at or above the charge threshold, the controller 24 may not pass energy from the thermoelectric device 20 to the rechargeable power storage device 22, or in some cases, may only pass a trickle charge to maintain anti/or top off the charge level of the rechargeable power storage device 22. Conversely, when the controller 24 detects that the rechargeable power storage device 22 has a charge level that has fallen below the charge threshold, the controller 24 may pass energy from the thermoelectric device 20 to the rechargeable power storage device 22 to recharge the rechargeable power storage device 22. In some cases, the controller 24 may obtain its operational power exclusively from the rechargeable power storage device 22, and thus maintaining a sufficient charge level on the rechargeable power storage device 22 may be necessary for continued operation of the controller 24 and thus the water heater 11.

In some cases, the memory storage 26 may be integral to the controller 24. included as a separate memory device, or both. The controller 24 may communicate with the memory storage 26 via one or more data/address lines. The memory storage 26 may be used to store any desired information, such as control algorithms, set points, schedule times, or instructions. The memory storage 26 may be any suitable type of storage device including, but not limited to RAM. ROM, EEPROM, flash memory, a hard drive, and/or the like. In some cases, the controller 24 may store information within the memory storage 26, and may subsequently retrieve the stored information. In some cases, the memory storage 26 may store a water usage profile 28. The water usage profile 28 may, in some cases, designate a number of higher water usage periods and a number of lower water usage periods, as illustrated for example in figure 8.

In some cases, the controller 24 may be in communication with a server 36. The server 36 may receive information from a cloud 38 and translate that information into information usable by the controller 24. In some cases, the server 36 may be part of the cloud 38. In some cases, a user may provide information to the server 36 (sometimes via the cloud 38) through a wireless and/or wired device (e.g., a smart device, a computer, and/or other suitable device) describing a desired water usage profile 28. The server 36 may then deliver that information to the controller 24, and that information may be stored as pan of the water usage profile 28 stored in the memory storage 26. In some cases, a user may specify other information to the server 36, such as an updated temperature set point for the water heater 11. The updated temperature set point may be communicated from the server 36 to the controller 24, and the controller 24 may then begin using the updated temperature set point. In some cases, the controller 24 can communicate information to the server 36, such as the current the temperature set point, some or all of the water usage profile 28 stored in the memory, certain performance parameters of the water heater 11 and the like. This information may be made accessible to a user (e.g., homeowner, contractor, etc.) via the cloud 38.

Figure 3:
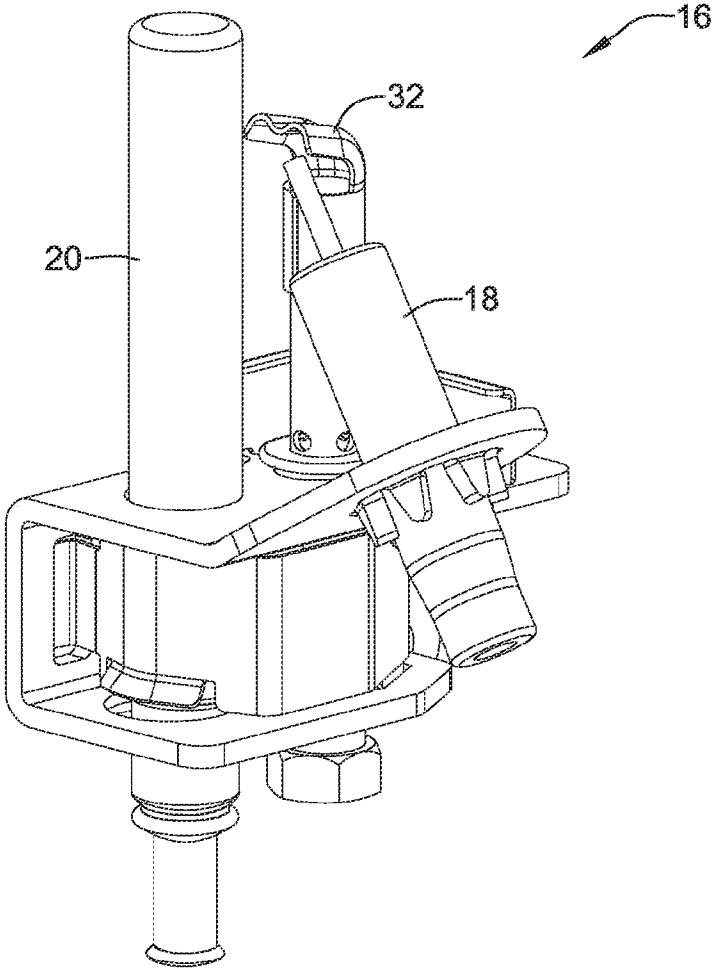
FIG. 3 is a schematic view of an example pilot assembly.

FIG. 3 is schematic view of an example pilot assembly 16. The example pilot assembly 16 includes three primary sub-assemblies: the ignitor 18, the pilot burner 32, and the thermoelectric device 20. During a state of system operation in which the pilot 16 must be run. the controller 24 opens the pilot valve 16A and powers the ignitor 18. which ignites the pilot flame at the pilot burner 32. The pilot assembly 16 is located in the water heater 11 such that it can act as the ignition source for the main burner 14. The pilot burner 32 is located in proximity to the thermoelectric device 20. such that the pilot flame is in thermal communication with the thermoelectric device 20. The thermoelectric device 20 converts at least a portion of the heat energy of the pilot flame into electrical energy to power the system control 10.

Figure 4:
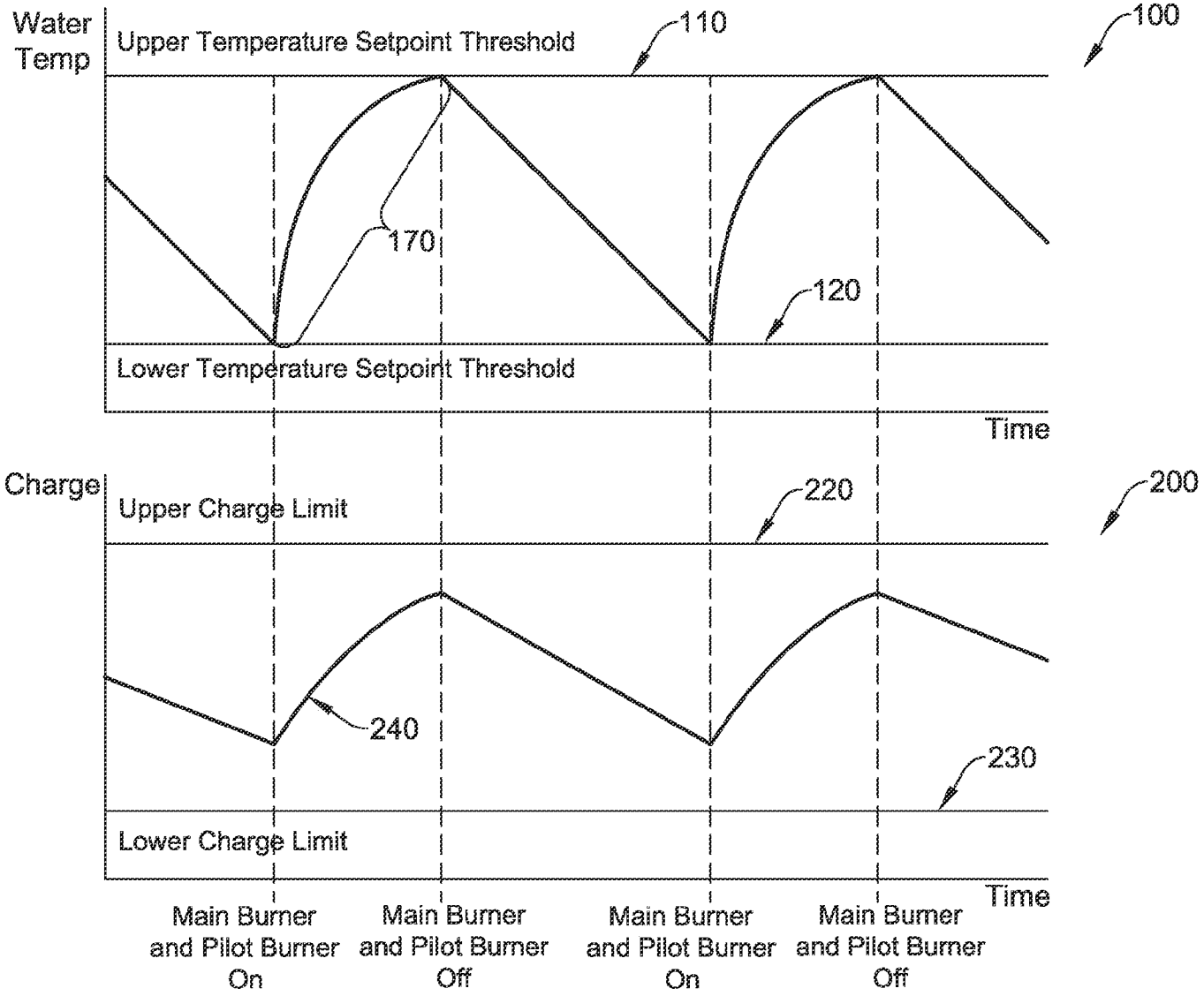
FIG. 4 is a graph depicting an example operation of a water heater with an intermittent flame-powered pilot combustion system.

FIG. 4 is a graph depicting an example operation of a water heater 11 with an intermittent flame-powered pilot combustion system as in FIGS. 1 -2. The water temperature is shown at 100. An upper temperature set point threshold is shown at 110 (e.g., often set in the temperature range of 130 to 150 degrees F) and a lower temperature setpoint threshold is shown at 120 (e.g., often set in the temperature range of 100 to 125 degrees F). The temperature of the water in the water tank 12, as sensed by water temperature sensor(s) 42A, 42B, is shown cycling between the lower temperature setpoint threshold 120 and the upper temperature setpoint threshold 110, with the main burner 14 and/or pilot 16 heating the water in the water tank 12 from the lower temperature setpoint threshold 120 to the upper temperature set point threshold 110, and then allowing the temperature of the water to drift back down to the lower temperature setpoint threshold 120.

The charge level of the rechargeable power storage device 22 is shown at 200, where an upper charge limit (e.g., a full charge level) is indicated at 220 and a lower charge limit is indicated at 230. It is contemplated that the upper charge limit (e.g., a full charge level) 220 and the lower charge limit 230 may each be considered thresholds, and sometimes may be referred to as the upper charge threshold 220 and the lower charge threshold 230. Although not explicitly shown in FIG. 4, there may also be a "stay alive" limit or threshold that is below the lower charge limit 230.

As illustrated in FIG. 4, when the water temperature drifts down to the lower temperature setpoint threshold 120 through heat loss from the water tank 12 and/or through a water draw(s), and when the charge level 240 is between the upper charge limit 220 and the lower charge limit 230, the controller 24 may heat the water in the water tank 12 with both the pilot 16 and the main burner 14 in a combination pilot and main burner mode as shown at 170, before turning off both the pilot 16 and the main burner 14 when the water temperature reaches the upper temperature setpoint threshold 110.

By turning off both the pilot 16 and main burner 14 when the water temperature reaches the upper temperature setpoint threshold 110, the water temperature will not continue to heat, as might occur in standing pilot appliances. This may help prevent the water temperature in the water tank 12 from reaching unsafe temperature levels (e.g., the safety temperature threshold, typically 165 degrees For 180 degrees F). Rather, the water temperature may gradually cool over time unlit the water temperature reaches the lower temperature set point threshold 120 as shown.

Figure 5A:
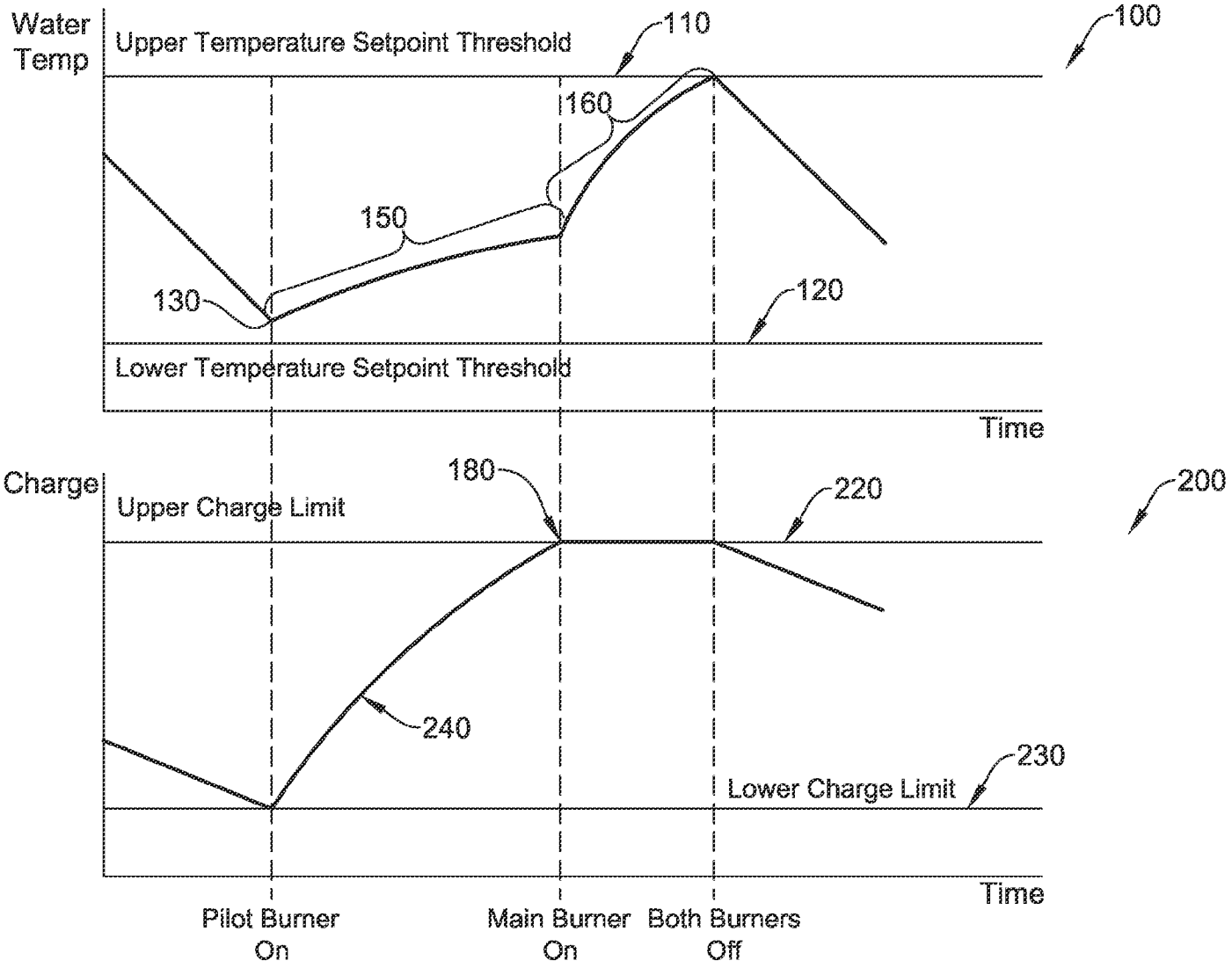
FIG. 5A is a graph depicting an example operation of a water heater with an intermittent flame-powered pilot combustion system using the pilot flame to recharge the rechargeable power storage device.

FIG. 5 A is a graph depicting another example operation of a water heater 11 with an intermittent flame-powered pilot combustion system using the pilot flame to recharge the rechargeable power storage device 22. In FIG. 5A, the charge level 240 has decreased to a point that the charge level 240 has reached the lower charge limit 230. This may occur when, for example, little or no water usage occurs resulting in relatively widely spaced and/or short burner "on" times. In another example, the controller 24, along with the ignitor 18, may draw more power than can be produced by the thermoelectric device 20 during a normal heating cycle. These are just a few examples. Regardless of the reason, the controller 24 may detect that the charge level 240 of the rechargeable power storage device 22 has reached the lower charge limit 230. At the same time, and as shown at 130 in FIG. 5A, the controller 24 may detect that the water temperature 100 is at or above the lower temperature setpoint threshold 120 and below the upper temperature setpoint threshold 110. When this occurs, the controller 24 may send a command to the pilot 16 and not the main burner 14 to initiate a pilot only mode for a first heating segment 150.

As illustrated in FIG. 5A, the thermoelectric device 20 may be exposed to the pilot flame, and thus may generate power whenever the pilot flame is present. As such, and when the controller 24 detects that the rechargeable power storage device 22 has a charge level 240 that has risen to at or above the upper charge limit 220, as shown by 180, the controller 24 may not pass further energy from the thermoelectric device 20 to the rechargeable power storage device 22, or in some cases, may only pass a trickle charge to maintain and/or top off the charge level 240 at the upper charge limit 220 of the rechargeable power storage device 22.

Because the pilot 16 is lit during the first heating segment 150, the thermoelectric device 20 will be exposed to the pilot flame, and will generate power that can be used by the controller 24 to recharge the rechargeable power storage device 22. The pilot 16 does not apply as much heat to the water in the water tank 12 as the main burner 14, and as such, in the pilot only mode, the temperature of the water in the water tank 12 increases at a lower heating rate than when the main burner 14 is on. While this does not heat the water to the upper temperature set point threshold 110 as fast as when the main burner 14 is also on, it docs allow the pilot 16 to be lit for a longer period of time during a water heater cycle. This may allow the power generated by the thermoelectric device 20 to he applied to recharge the rechargeable power storage device 22 for a longer period of time, which may allow the rechargeable power storage device 22 to he charged further during a heating cycle. In some cases, the first heating segment 150 may be sufficient to restore the charge level 240 to an upper charge limit 220 (e.g., a foil charge level) as shown by 180 in FIG. 5A. In FIG. 5A, the first healing segment 150 is maintained until the rechargeable power storage device 22 is fully charged. In the example of FIG. 5A. once the rechargeable power storage device 22 is fully charged, the controller 24 may send a command to the pilot 16 and the main burner 14 to initiate the combination pilot and main burner mode where both the pilot 16 and the main burner 14 are lit for a second heating segment 160 until the water in the water heater 11 reaches the upper temperature setpoint threshold 110. When the controller 24 detects that the rechargeable power storage device 22 has a full charge, such as at time 180. the controller 24 may not pass energy from the thermoelectric device 20 to the rechargeable power storage device 22, or in some cases, may only pass a trickle charge to maintain and/or top off the charge level 240 of the rechargeable power storage device 22.

Figure 5B:
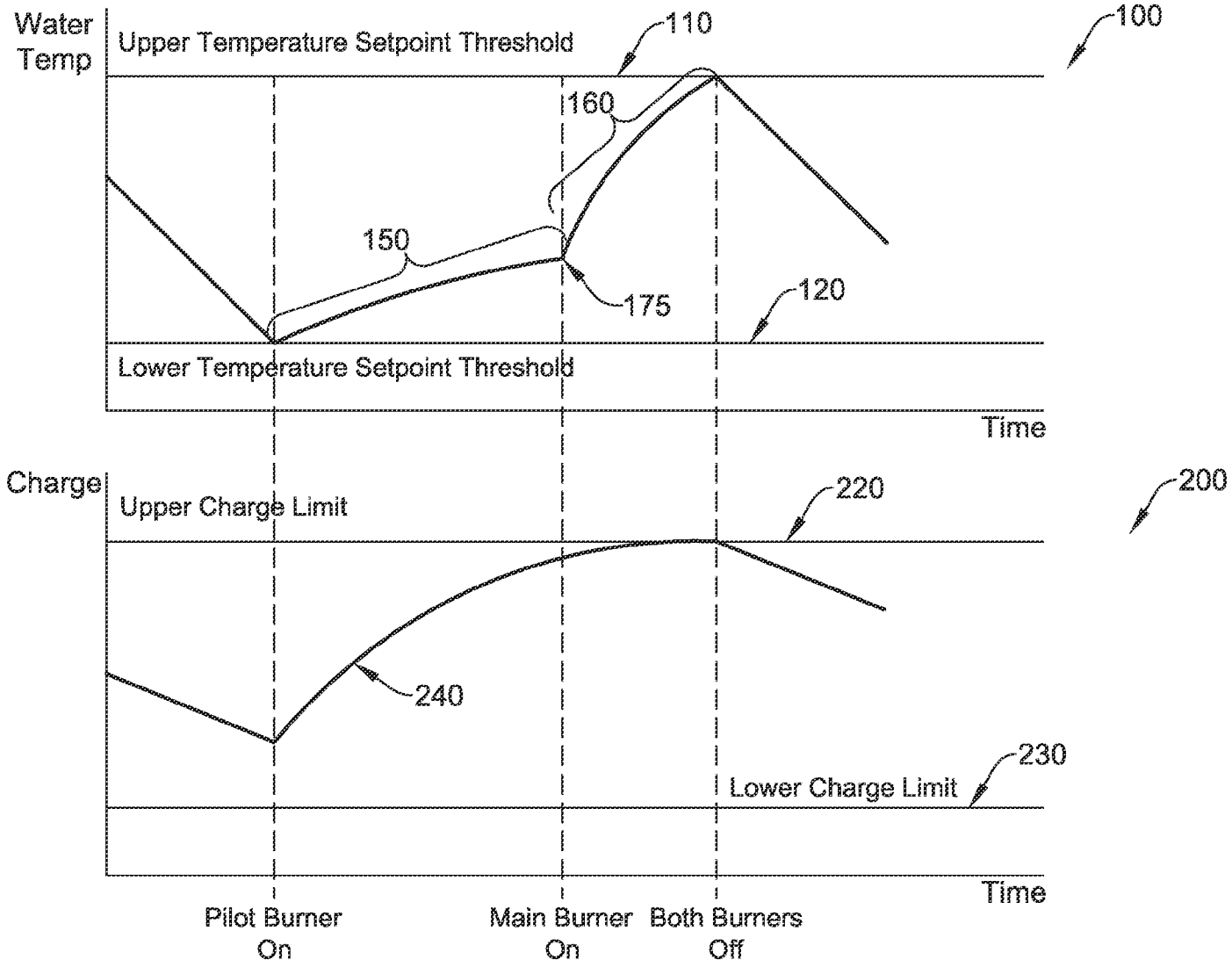
FIG. 5B is a graph depicting an example operation of a water heater with an intermittent flame-powered pilot combustion system using the pilot flame followed by the main burner to recharge the rechargeable power storage device.

FIG. 5B is similar to FIG. 5A, except the first hearing segment 150 and the second heating segment 160 are controlled by the controller 24 such that the charge level 240 of the rechargeable power storage device 22 becomes fully charged approximately at the same time as the temperature in the water heater 11 reaches the upper temperature setpoint threshold 110. The controller 24 may detect die current charge level 240 of the rechargeable power storage device 22, and using an expected recharge rate of the rechargeable power storage device 22 from energy supplied by the thermoelectric device 20 when exposed to the pilot flame, may estimate how long it will take to fully charge the rechargeable power storage device 22. The controller 24 may also detect the current temperature of the water in the water tank 12, and may estimate how long it will take to heat the water in the water heater 11 to the upper temperature setpoint threshold 110 using the pilot only mode for a first heating segment 150 followed by the combination pilot and main burner mode during a second heating segment 160. The controller 24 may determine a transition time 175 to transition between the pilot only mode of the first heating segment 150 and the combination pilot and main burner mode of the second heating segment 160 so that the sum duration of the first heating segment 150 and the second heating segment 160 approximates the estimated time to fully recharge the rechargeable power storage device 22. Thus, in this example, the charge level 240 of the rechargeable power storage device 22 may become fully charged at approximately the same time that the temperature in the water heater 11 reaches the upper temperature setpoint threshold 110.

Figure 6:
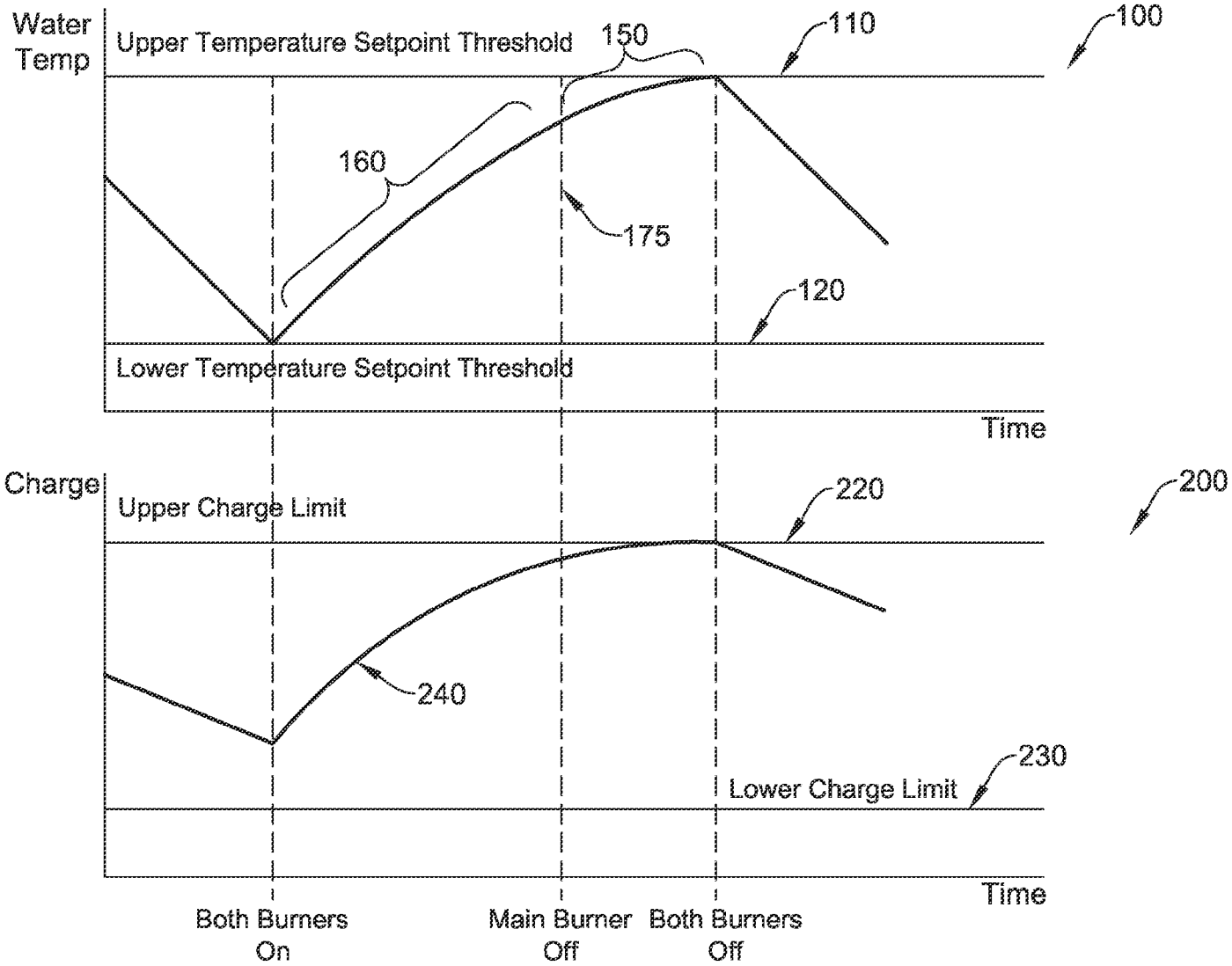
FIG. 6 is a graph depicting another example operation of a water heater with an intermittent flame-powered pilot combustion system using the pilot flume followed by the main burner to recharge the rechargeable power storage device.

FIG. 6 is similar to FIG. 5B, hut the controller 24 uses the combination pilot and main burner mode during the second heating segment 160 before using the pilot only mode during the first heating segment 150. The controller 24 may determine a transition lime 175 to transition between the combination pilot and main burner mode of the second heating segment 160 and the pilot only mode of the first heating segment 150 so that the sum duration of the second heating segment 160 and the first heating segment 150 approximates the estimated time to fully recharge the rechargeable power storage device 22. In this example, the charge level 240 of the rechargeable power storage device 22 may become fully charged at approximately the same time that the temperature in the water heater 11 reaches the upper temperature setpoint threshold 110. In this example, the temperature of the water may be heated faster toward the upper temperature setpoint threshold 110, and thus may be preferred during periods of expected high water usage. It will likely consume more energy overall compared to the method of FIG. 5B because the water will be maintained at a higher temperature for a longer period of time and thus more heat will be lost to ambient through the water heater tank walls.

Figure 7A:
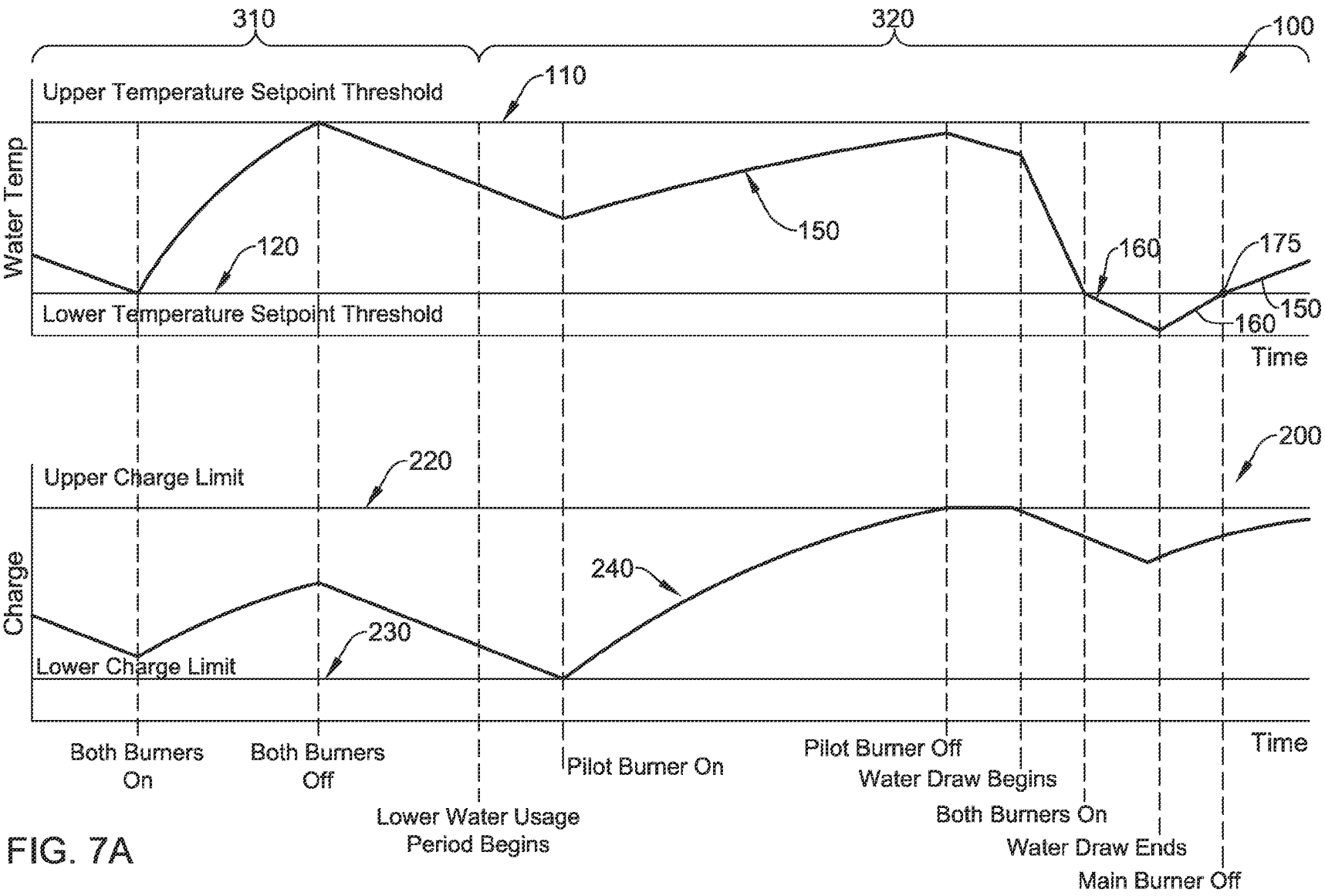
FIGS. 7A and 7B are graphs depicting examples of operation of a water heater having an intermittent flame-powered pilot combustion system when using a water usage profile.

FIG. 7A is a graph depicting an example operation of a water heater 11 having an intermittent flame-powered pilot combustion system when using a water usage profile 28. As discussed above, the memory storage 26 may store a water usage profile 28, which may designate one or mom higher water usage periods 310 and one or more lower water usage periods 320. The water usage profile 28 may be used to inform the controller 24 when to use the pilot only mode of the first heating segment 150 or the combination pilot and main burner mode of the second heating segment 160. The water usage profile 28 may be stored in the memory storage 26 and/or may be provided from an external source (e.g. network connected server). During periods when there is an expected low level of hot water demand (e.g., the lower water usage period 320), slower water temperature recovery using the pilot only mode may be acceptable (e.g., the first heating segment 150). In the example shown, the controller 24 may utilize the pilot only mode to increase the time that rechargeable power storage device 22 is charged during a heating cycle. In some cases, the pilot only mode may be sufficient to raise the water temperature 100 to the upper temperature setpoint threshold 110 and increase the charge level 240 of the rechargeable power storage device 22 to the upper charge limit 220 (e.g., the full charge level), at which point the pilot only mode may be terminated. In some cases, the first heating segment 150 may increase the charge level 240 of the rechargeable power storage device 22 to the upper charge limit 220 (e.g., the full charge level) before the temperature of the water in the water heater 11 has reached the upper temperature setpoint threshold 110. In this case, the pilot only mode may continue to be used or the combination pilot and main burner mode may be used until the water temperature 100 is raised to the upper temperature setpoint threshold 110. hut this would be optional.

During the higher water usage period 310, as determined by the water usage profile 28, the controller 24 may attempt to only use the second heating segment 160 in the combination pilot and main burner mode to heat the water from the lower temperature setpoint threshold 120 to the upper temperature setpoint threshold 110. The first heating segment 150 using the pilot only mode may not be used unless necessary, for example, if the charge level 240 were to drop below the lower charge limit 230 but the water temperature was above the lower temperature setpoint threshold 120, the pilot only mode may be used to heat the water while raising the charge level 240 to the upper charge limit 220. In another example, if the charge level 240 of the rechargeable power storage device 22 were to continue to fall further below the lower charge limit 230 for "N" consecutive heating cycles (where N is an integer greater than 1), the controller 24 may interject a first heating segment 150 using the pilot only mode to help restore the charge level 240 of the rechargeable power storage device 22. In general, the controller 24 may interject such a first heating segment 150 using the pilot only mode when necessary to maintain an adequate charge on the rechargeable power storage device 22.

Figure 7B:
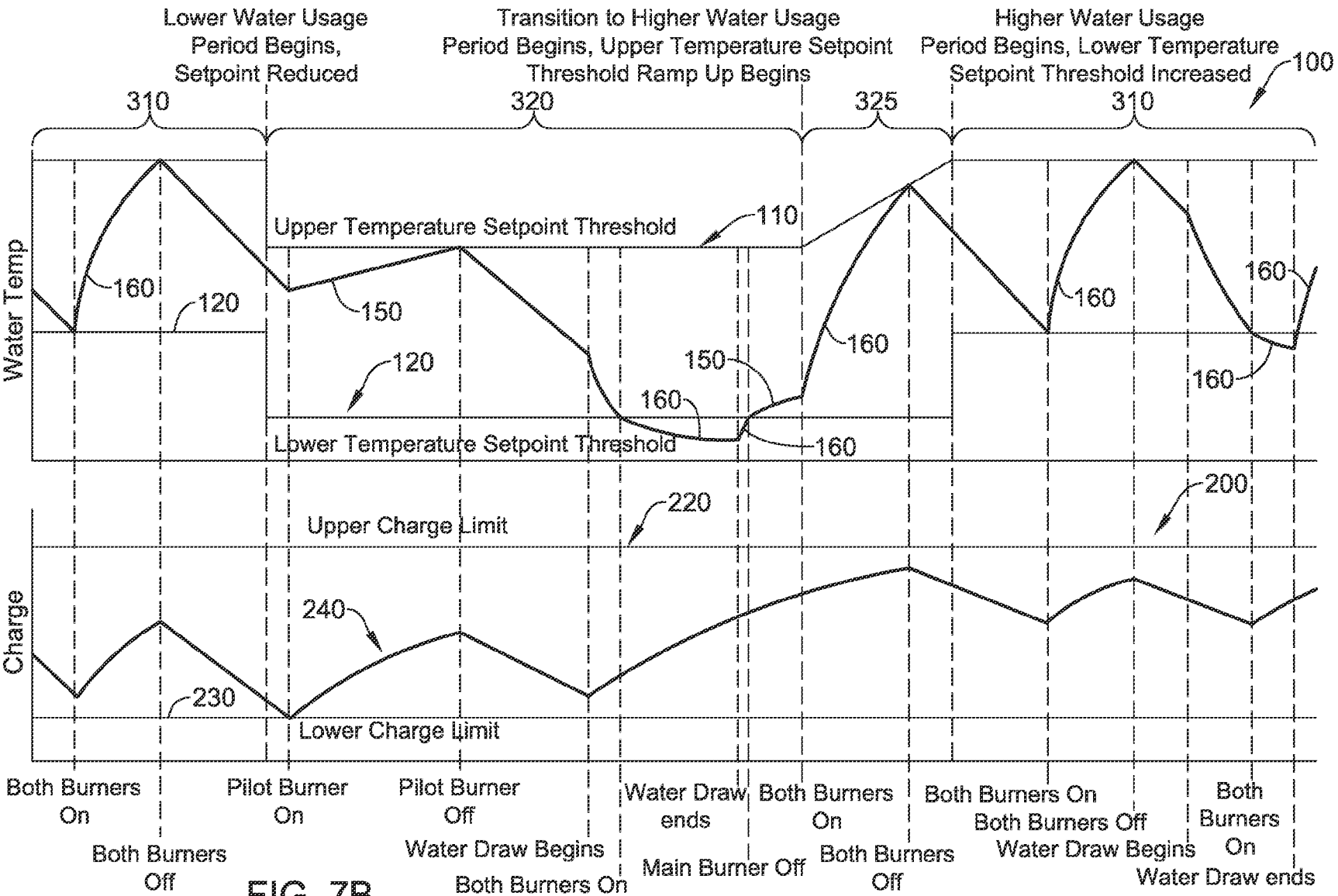

During the lower water usage period 320, it is often desirable to decrease the water temperature setpoint to save energy, as shown in FIG. 7B. The lower water usage period 320 may be a period when not as much hot water will be used and/or the water temperature 100 doesn't need to be as high. When so provided, the controller 24 may selectively lower the upper temperature setpoint threshold 110 and/or the lower temperature setpoint threshold 120 to help save energy, as shown in FIG. 7B. At the end of the lower water usage period 320, the upper temperature setpoint threshold 110 and/or the lower temperature setpoint threshold 120 would be changed to the values required by the next higher water usage period 310. Optionally, the controller 24 may ramp the upper temperature setpoint threshold 110 from the lower water usage period 320 value to the higher water usage period 310 value over some predetermined period of time (as indicated at 325). This would allow the water temperature to increase to a value closer to the intended value of the higher water usage period 310 which would reduce the number of burner cycles required at transitions between water usage periods.

In FIG. 7B, the upper temperature set point threshold 110 ramps up during a ramp period 325 in anticipation of a higher water usage period 310. While a ramp is shown, it is contemplated that the upper temperature setpoint threshold 110 and/or the lower temperature setpoint threshold 120 may be changed in a step or a series of steps, as desired. During the ramp period 325 (e.g., a transition period) while the upper temperature setpoint threshold 110 may be ramped up, the controller 24 may behave the same as during the higher water usage period 310, but the lower temperature setpoint threshold 120 and the upper temperature setpoint threshold 110 would not have returned to the values of the higher water usage period 310.

In these and other embodiments, once the water temperature 100 has risen to the upper temperature setpoint threshold 110, the pilot 16 and the main burner 14 may receive commands from the controller 24 to shut down. By shutting down both the pilot 16 and the main burner 14 once the water temperature 100 has risen to the upper temperature setpoint threshold 110, the water temperature 100 will not continue to heat to dangerous levels, as could occur with standing pilot appliances.

However, in some cases, it is possible for the water temperature 1(H) to continue to heat. For example, in high ambient temperatures, and when the temperature setpoint is set fairly tow. the charge level 240 may drop to the lower charge limit 230 and the water temperature 100 may be above the upper temperature setpoint threshold 110. To handle this condition, the controller 24 may incorporate a minimum "stay alive" charge threshold (not shown) which is lower than the lower charge limit 230. There may also be a "low charge" safety temperature threshold (not shown). If the charge is below the lower charge limit 230, but above the "stay alive" charge threshold, then the pilot 16 may be lit to recover charge until the charge level reaches the upper charge limit 220 or the water temperature 100 reaches the upper temperature setpoint threshold 110 If the charge drops to the "stay alive" charge threshold, then the pilot may be lit to recover charge until the charge reaches the upper charge limit 220 or the water temperature 100 reaches the safety temperature threshold.

In some eases, the controller 24 may learn a water usage profile 28 by monitoring the water usage over time. For example, hot water usage may be monitored over seven days or longer. A daily usage profile, margin of error and daily pattern may be determined. A weekly usage pattern or day by day usage pattern may be maintained, thereby creating a water usage profile 28 that may be used by the controller 24 to determine when to initiate the first heating segment 150 using the pilot only mode and/or the second heating segment 160 using the combination pilot and main burner mode as discussed above.

In some cases, a user may create a weekly usage profile using a user interface of the controller 24, an external user interface of a computer, or other device (e.g., a smart device). The device may accept a water usage profile 28 from the user, which may specify expected water usage for each day of a week and at what times. In some cases, a user may enter such information through a wireless and/or wired device (e.g., a smart device, a computer, and/or other suitable device), which may then be transmitted to a server 36. That information may he delivered and stored in the water usage profile 28 stored in the memory storage 26. In some cases, a weekly usage routine for a day by day usage pattern may be updated as needed. In some cases, it may be contemplated that there are multiple higher water usage periods 310 in a day and/or multiple lower water usage periods 320 in a day. It may be further contemplated that these water usage periods may vary from day to day.

Figure 8:
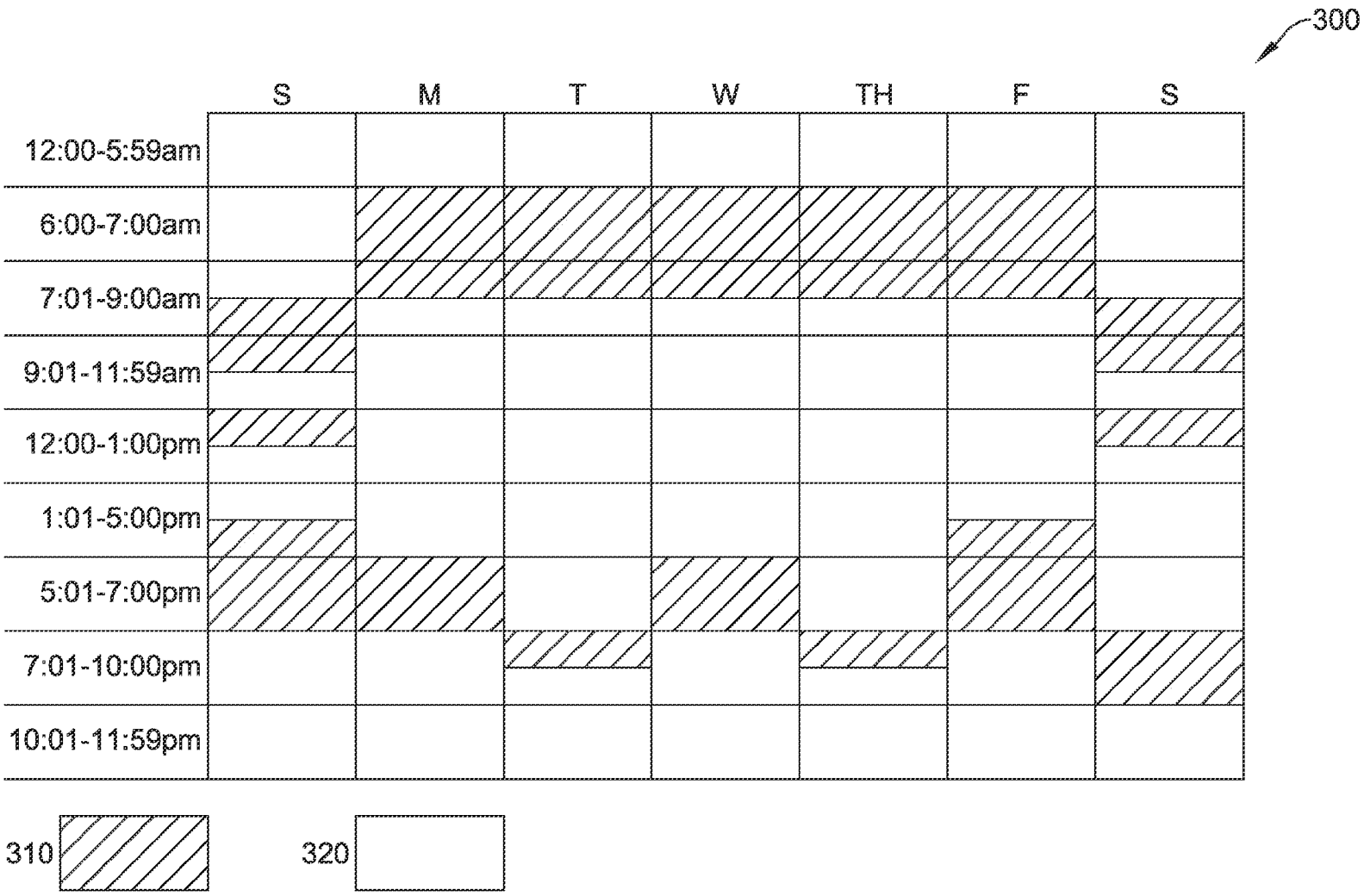
FIG. 8 is a chart depicting an example water usage profile.

FIG. 8 is an illustrative chart depicting an exemplary water usage profile 28. The chart is a sample weekly schedule illustrating the higher wafer usage periods 310 and the lower water usage periods 320. In the example shown, and specifically referencing Monday (M), the higher water usage periods 310 fall from 6:00 am until 8:00 am. This time frame may be indicative of a lime when a household and/or user may be awake and getting ready for the day (e.g., taking a shower, making breakfast, and/or other routine activities) and then again from 5:01 pm until 7:00 pm when a household and/or user may be making dinner and/or other evening activities requiring hot water (e.g., running a dishwasher). The lower water usage periods 320 may tall on M from 8:00 am until 5:00 pm because this may be a time when a household and/or user are not in the home (e.g., at work, at school). and again from 7:01 pm until 6:00 am as this may be a time when a household and/or user are not performing activities requiring hot water (e.g., watching television, sleeping, or other such activities). The other days of the week may have the same or different higher water usage periods 310 and lower water usage periods 320, such as shown in FIG. 8.

Figure 9:
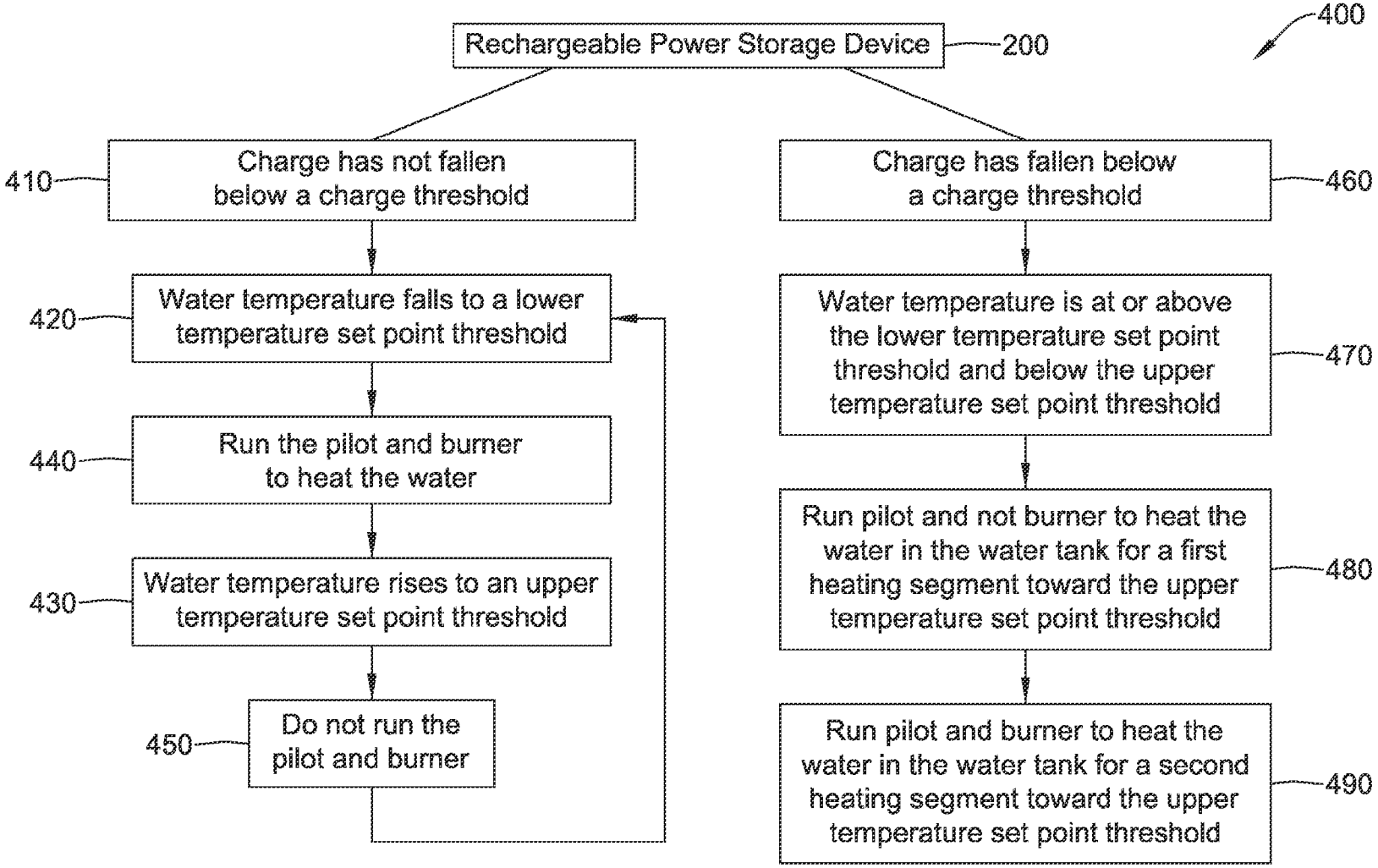
FIG. 9 is a flow diagram showing an example method of controlling a water heater with an intermittent flame-powered pilot combustion system.

FIG. 9 depicts an exemplary method 400 for controlling a water heater. At 410, the rechargeable power storage device charge level 200 has a charge that has not fallen below a charge threshold. At 420. when the charge has not fallen below the charge threshold, and the water temperature falls to a lower temperature set point threshold, the water heater 11 runs the pilot and the burner to heat the water at shown at 440. At 430, when the water temperature rises to an upper temperature setpoint threshold, the water heater 11 will no longer ran the pilot and the burner as shown at 450.

At 460, the rechargeable power storage device charge level 200 has a charge that has fallen below the charge threshold. At 470, when the charge has fallen below the charge threshold and the water temperature is at or above the lower temperature setpoint threshold and below the upper temperature setpoint threshold, the water heater may run the pilot and not the burner (i.e. pilot only mode) to heat the water in the water tank for a first heating segment toward the upper temperature setpoint threshold as shown at 480. The water heater may then nut the pilot and the burner (i.e. combination pilot and burner mode) to heat the water in the water tank for a second heating segment toward the upper temperature setpoint threshold as shown at 490.

Figure 10:
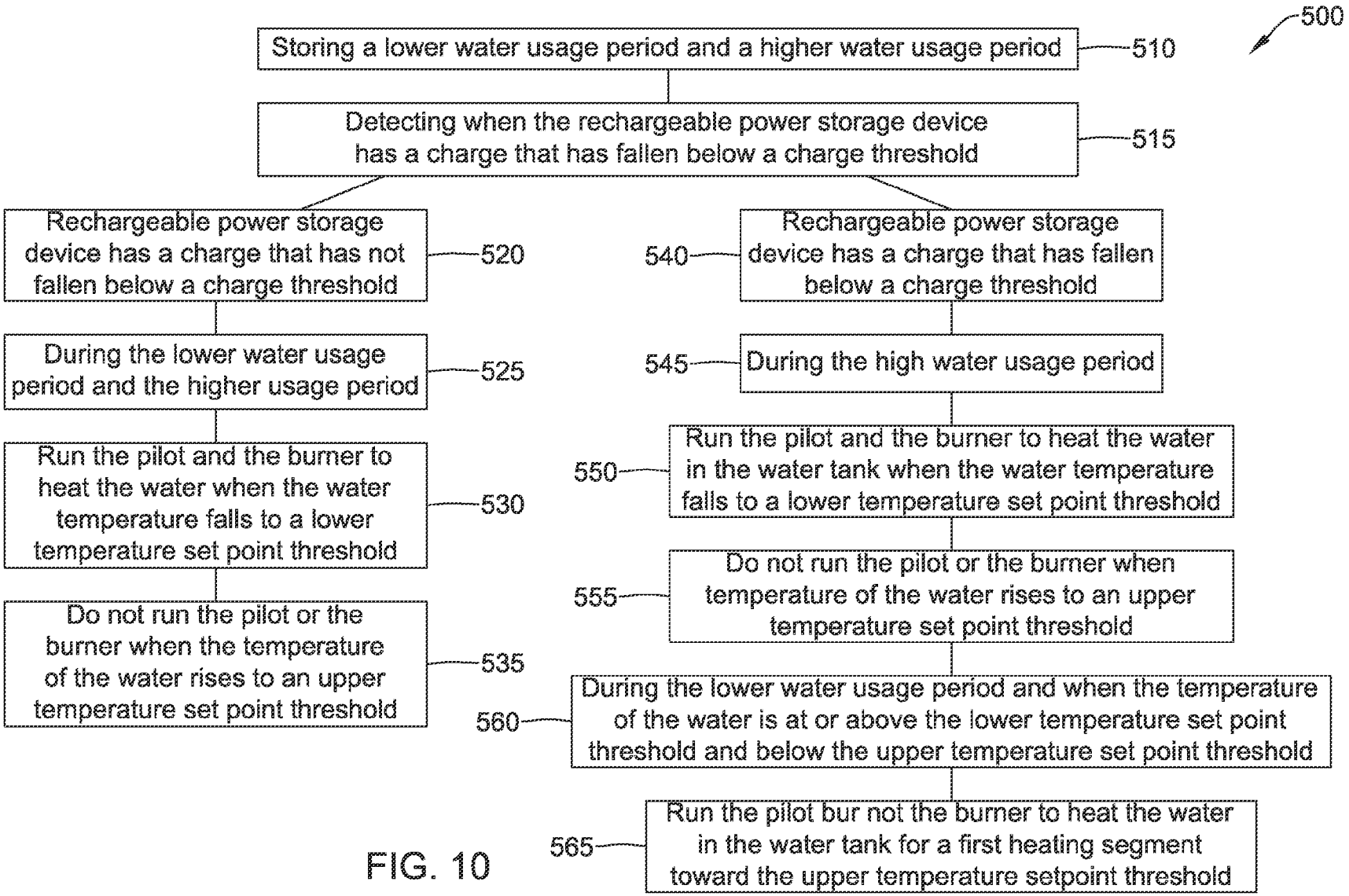
FIG. 10 is a flow diagram showing another example method of controlling a water heater with an intermittent flame-powered pilot combustion system.

FIG. 10 depicts an exemplary method 500 for controlling a water heater utilizing a water usage profile. At 510, the water usage profile s may store one or more lower water usage periods and one or more higher water usage periods. At 515, the controller may detect when the rechargeable power storage device has a charge that has fallen below a charge threshold. In the case when the rechargeable power storage device hits a charge that has not fallen below a charge threshold as shown at 520, and during the lower water usage period and the higher usage period 525, the water heater may run the pilot and the burner (i.e. combination pilot and burner mode) to heat the water when the water temperature falls to a lower temperature setpoint threshold as shown at 530. At 535, when the temperature of the water rises to an upper temperature setpoint threshold, the water heater may no longer run the pilot or the burner.

In the case when the rechargeable power storage device has a charge that has fallen below a charge threshold as shown at 540, and during a high water usage period as shown at 545. the water heater may run the pilot and the burner (i.e. combination pilot and burner mode) to heat the water in the water tank when the water temperature falls to a lower temperature setpoint threshold as shown at 550. When the temperature of the water rises to an upper temperature setpoint threshold, the water heater may no longer run the pilot or the burner as shown at 555. As shown at 560, during the lower water usage period, and when the temperature of the water is at or above the lower temperature set point threshold and below the upper temperature setpoint threshold, the water heater may run the pilot but not the burner (i.e. pilot only mode) to heat the water in the water tank for a first heating segment toward the upper temperature setpoint threshold at shown at 565. In addition or alternative, and although not explicitly shown, another exemplary method for controlling a water heater may include the water usage profile determining when to heat the water in the water tank 12 to a temperature set-point using only the pilot 16, and not using the main burner 14 at all. When so provided, the water usage profile may be used to determine if there is sufficient time to heat the water using the pilot 16 only (e.g. sufficient time before an upcoming high water usage period).

Figure 11:
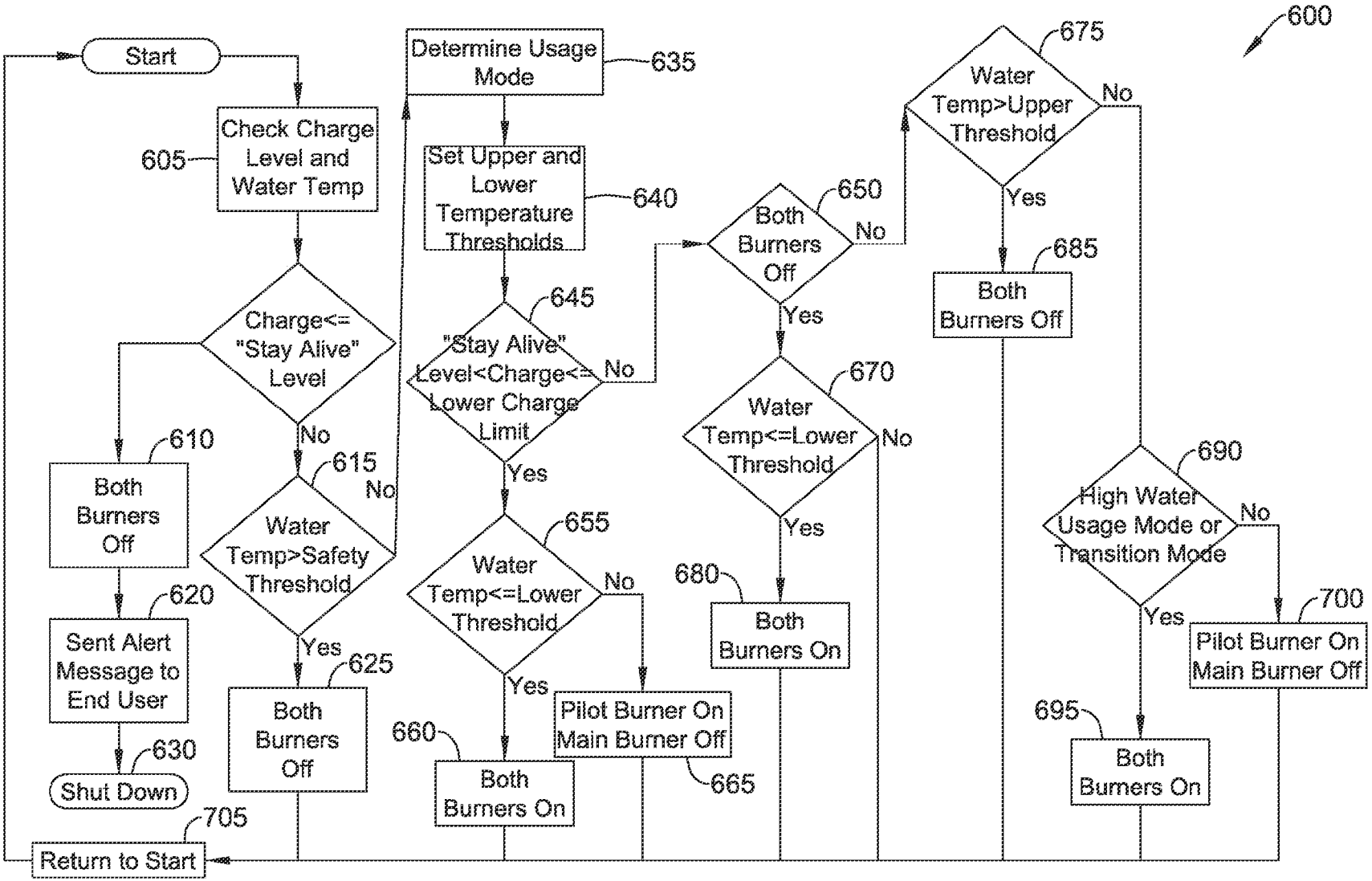
FIG. 11 is a flow diagram showing yet another example method of controlling & water heater with an intermittent flame -powered pilot combustion system.

FIG. 11 depicts another exemplary method 600 for controlling a water heater. At 605, the controller may check the charge level and the water temperature. If the charge level is less than or equal to a "stay alive" charge threshold 610, both the pilot and the main burner are turned off. At this point, the controller may send an alert message to an end user 620 and then shut down the system as shown at 630. However, if the charge level is greater than or equal to the "stay alive" charge threshold, the controller determines if the water temperature is greater than the safety temperature threshold, as shown in 615. If the water temperature is greater than the safety temperature threshold, then both the pilot and the main burner are turned off as shown at 625, and the system returns to start as shown at 705. If the water temperature is lower than the safely temperature threshold, then the controller enters a determine usage mode 635 (e.g., high water usage mode, low water usage mode, or transition mode). Once the usage mode is determined, the controller may set the upper and lower temperature setpoint thresholds as shown at 640.

At 645, if the charge level is above the "stay alive" charge threshold but less than or equal to the lower charge limit, and the water temperature is less than or equal to the lower temperature setpoint threshold as shown at 655, both the pilot and the main burner are turned off as shown at 660 and the system returns to start as shown at 705. At 655, if the water temperature is not less than or equal to the lower temperature setpoint threshold (e.g., the water temperature is between the lower temperature setpoint threshold and the safety temperature threshold), the pilot is turned on and the main burner is turned off, and the system may return to start as shown at 705.

If at 645 the charge level is not between the "stay alive" charge threshold and the lower charge limit, then the charge level must be between the lower charge limit and the upper charge limit and the burner state would then be evaluated as shown at 650.

If at 650 both the pilot and the main burner are off, and if at 670 the water temperature is less than or equal to the lower temperature setpoint threshold, then both the pilot and the main burners would be turned on. as shown at 680. If at 650 both the pilot and the main burner are off, and if at 670 the water temperature is greater than the lower temperature setpoint threshold, then the pilot and the main burner would remain in their current state and the system would return to start as shown at 705.

If at 650 either the pilot is on, or both the piled and the mam burner are on, and if at 675 the water temperature is above the upper temperature setpoint threshold, then both the pilot and main burner would be turned off, as shown in 685, and the system would return to start as shown at 705. If at 650, either the pilot is on, or both the pilot and the main burner are on, and if at 675 the wafer temperature is below the upper temperature setpoint threshold, then the usage mode must be evaluated, as shown at 690.

If at 690 the usage mode is either the high water usage mode or the transition mode, then both the pilot and main burner may be turned on as shown in 695 and the system would return to start as shown at 705. If at 690 the usage mode is the low water usage mode, then the pilot would be turned on and the main burner would be turned off, as shown in 700 and the system would return to start as shown at 705.

The disclosure should not be considered limited to the particular examples described above, but rather should be understood to cover all aspects of the disclosure as set out in the attached claims. Various modifications, equivalent processes, as well as numerous structures to which the disclosure can be applicable will be readily apparent to those of skill in the art upon review of the instant specification.

What is claimed is:

1. A water heater comprising:

a water tank;

a burner;

a pilot for igniting the burner; an ignitor for igniting the pilot;

a thermoelectric device in thermal communication with a flame of the pilot; a controller; and a rechargeable power storage device for supplying power to the ignitor and the controller, the rechargeable power storage device being rechargeable using energy produced by the thermoelectric device in response to heat from the flame of the pilot;

wherein the controller is configured to:

in response to detecting that a rechargeable power storage device has a first charge level that is below a charge threshold and in response to a temperature of water in the water tank of the water heater being a first temperature that is at or above a lower temperature setpoint threshold and below an upper temperature setpoint threshold:

cause the ignitor to ignite the pilot of the water heater;

after igniting the pilot, cause the pilot to run without running the burner for a first heating segment; and after igniting the pilot, cause the pilot and the burner to run to heat the water in the water tank for a second heating segment toward the upper temperature setpoint threshold; and in response to detecting that the rechargeable power storage device has a second charge level that is below the charge threshold and in response to the temperature of the water in the water tank being a second temperature that is at or above the upper temperature setpoint threshold:

cause the ignitor to ignite the pilot without running the burner.

2. The water heater of claim 1, wherein the controller is further configured to:

in response to detecting that the rechargeable power storage device has a third charge level that is above the charge threshold:

cause the ignitor to ignite the pilot and the burner to heat the water in the water tank of the water heater in response to the temperature of the water in the water tank being below the lower temperature setpoint threshold; or cause the pilot and the burner to not run in response to the temperature of the water in the water tank being at or above the upper temperature setpoint threshold.

3. The water heater of claim 1, wherein the first heating segment occurs after the second heating segment.

4. The water heater of claim 1, wherein the controller is further configured to determine a first duration for the first heating segment and a second duration for the second heating segment such that there is sufficient time to fully recharge the rechargeable power storage device using energy produced by the thermoelectric device before the water in the water tank is heated to the upper temperature setpoint threshold.

5. The water heater of claim 1, wherein the charge threshold is below fully charged.

6. The water heater of claim 1, wherein the controller is further configured to:

cause the pilot to run without running the burner of the water heater for the first heating segment before causing the pilot and the burner to run to heat the water in the water tank for the second heating segment toward the upper temperature setpoint threshold.

7. The water heater of claim 1, wherein the controller is further configured to:

cause the pilot to run without running the burner of the water heater for the first heating segment after causing the pilot and the burner to run to heat the water in the water tank for the second heating segment toward the upper temperature setpoint threshold.

8. The water heater of claim 1, wherein the charge threshold is a first charge threshold that is higher than a second charge threshold and the controller is further configured to:

while the temperature of water in the water tank of the water heater is at or above the upper temperature setpoint threshold and in response to detecting that the rechargeable power storage device has a third charge level that is below the second charge threshold, causing the ignitor to ignite the pilot of the water heater.

9. The water heater of claim 8, wherein the controller is further configured to:

cause the pilot to turn off in response to the temperature of water in the water tank of the water heater being at or above a third temperature setpoint threshold, wherein the third temperature setpoint threshold is higher than the upper temperature setpoint threshold.

10. The water heater of claim 8, wherein the controller is further configured to:

cause the pilot to turn off in response to the rechargeable power storage device having a fourth charge level that is at or above the first charge threshold.

* * * * *